US005733170A

United States Patent [19]

Wotton

[11] Patent Number: 5,733,170

[45] Date of Patent: Mar. 31, 1998

[54] DECORATIVE FIGURE ASSEMBLY FROM COMBINATION OF COMPONENT BAGS

[75] Inventor: Michael C. Wotton, Plantsville, Conn.

[73] Assignee: Sun Hill Industries, Inc., Stamford, Conn.

[21] Appl. No.: 653,759

[22] Filed: May 23, 1996

[51] Int. Cl.[6] ..... A63H 3/04; A63H 3/16; B65D 65/00

[52] U.S. Cl. ..... 446/385; 446/73; 446/223; 206/457; 206/575; 428/16

[58] Field of Search ..... 206/457, 575; 428/16; 446/73, 385, 221, 223

[56] References Cited

U.S. PATENT DOCUMENTS

| | | | |
|---|---|---|---|
| D. 334,340 | 3/1993 | Parrish et al. | 206/457 |
| 1,379,013 | 5/1921 | Goss | 446/371 |
| 2,879,626 | 3/1959 | Gradwohl | 446/371 |
| 4,883,441 | 11/1989 | Byer | 446/99 |
| 4,884,991 | 12/1989 | Terzian | 446/369 |
| 5,195,638 | 3/1993 | Zinbarg | 206/457 |
| 5,211,996 | 5/1993 | Zinbarg | 428/16 |
| 5,215,493 | 6/1993 | Zgrogek et al. | 446/372 |
| 5,458,932 | 10/1995 | Zinbarg et al. | 428/16 |

FOREIGN PATENT DOCUMENTS

| | | | |
|---|---|---|---|
| 572581 | 11/1959 | United Kingdom . | |
| 828763 | 2/1960 | United Kingdom | 446/221 |

*Primary Examiner*—Robert A. Hafer
*Assistant Examiner*—Laura Fossum
*Attorney, Agent, or Firm*—David P. Gordon; David S. Jacobson

[57] ABSTRACT

A decorative combination of component bags representing the torso, head, two arms and two legs of a festive, seasonal, holiday, or non-holiday figure is provided. Each of the bags is comprised of a bag member formed of a flexible waterproof material and preferably formed having a presealed end and an initially open end opposite the presealed end. The initially open end is for receiving filler material. The presealed end of the head bag is shaped such that the head bag assumes a generally spherical shape once filled with filler material. The pre-sealed end of the torso bag is shaped such that the torso bag assumes a generally cylindrical shape once filled with filler material. The pre-sealed ends of the two arm bags and two leg bags are shaped such that the arm bags and leg bags assume a generally elongate cylindrical shape once filled with filler material. A closing means is provided for closing the initially open ends of the component bags. The bags may have fanciful indicia for representing festive, seasonal, holiday, or non-holiday figures. Once assembled, the figure resembles a costumed male or female human, is substantially human-proportioned, and has articulable appendages. The components of the figure may also be supplied in a kit.

26 Claims, 8 Drawing Sheets

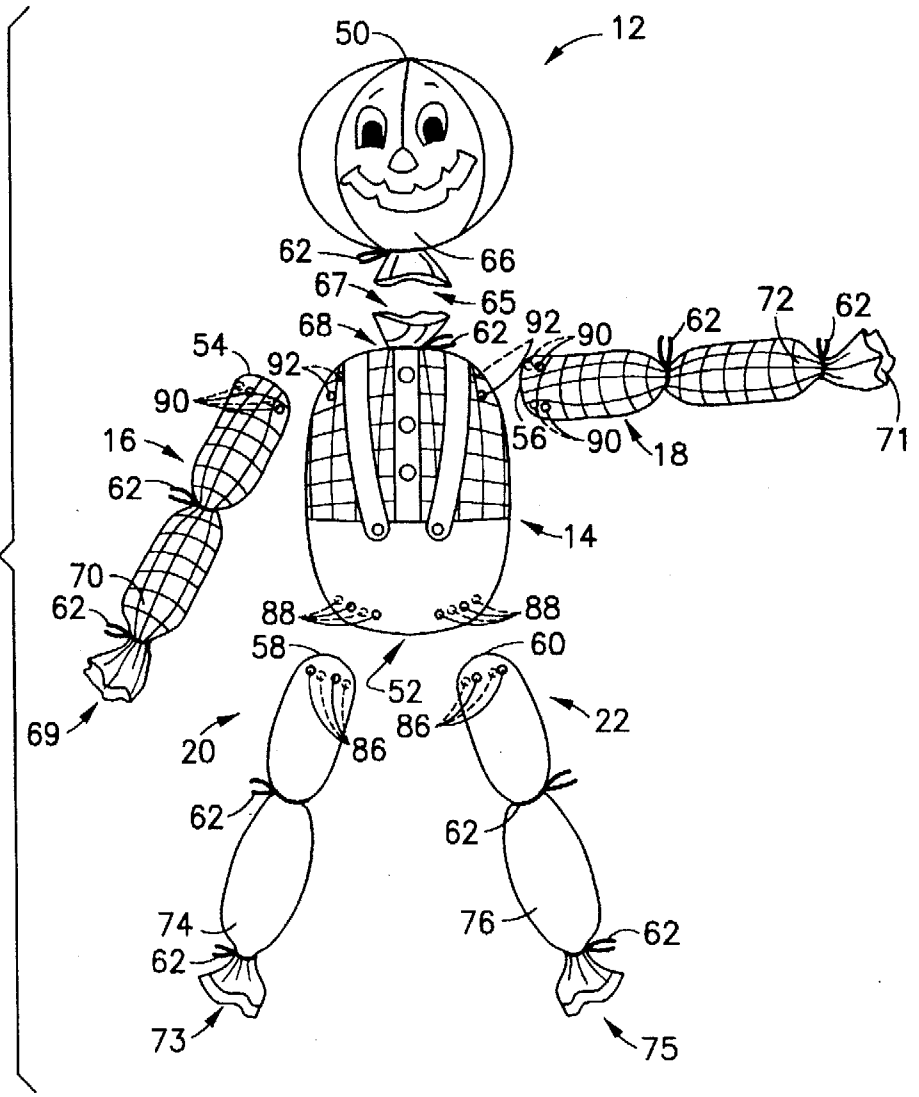
FIG. 2
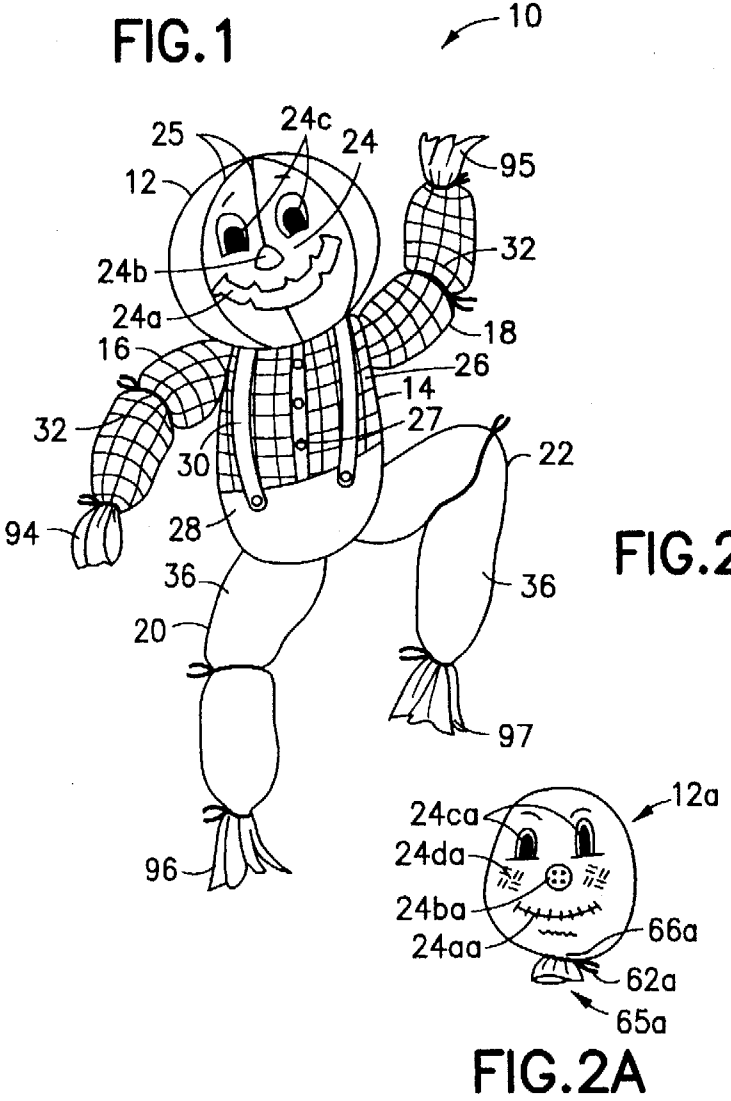
FIG. 1
FIG. 2A

FIG. 4(A)
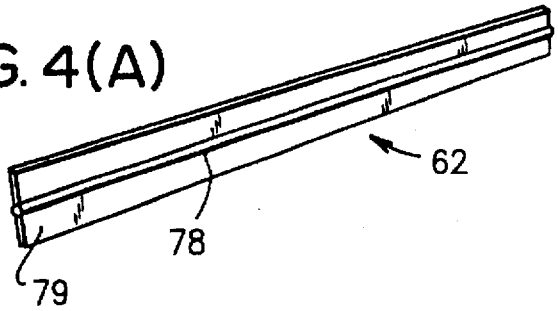
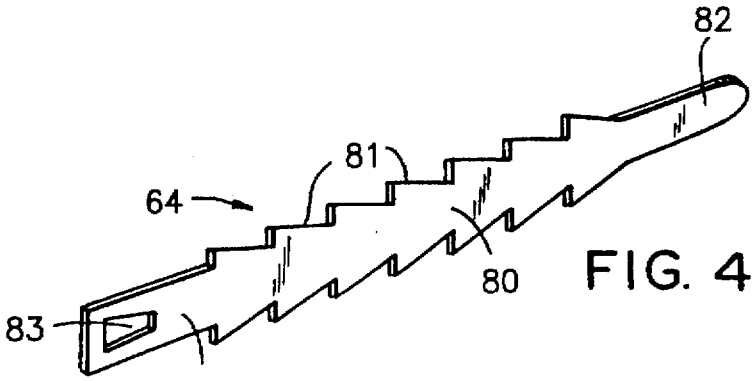
FIG. 4(B)
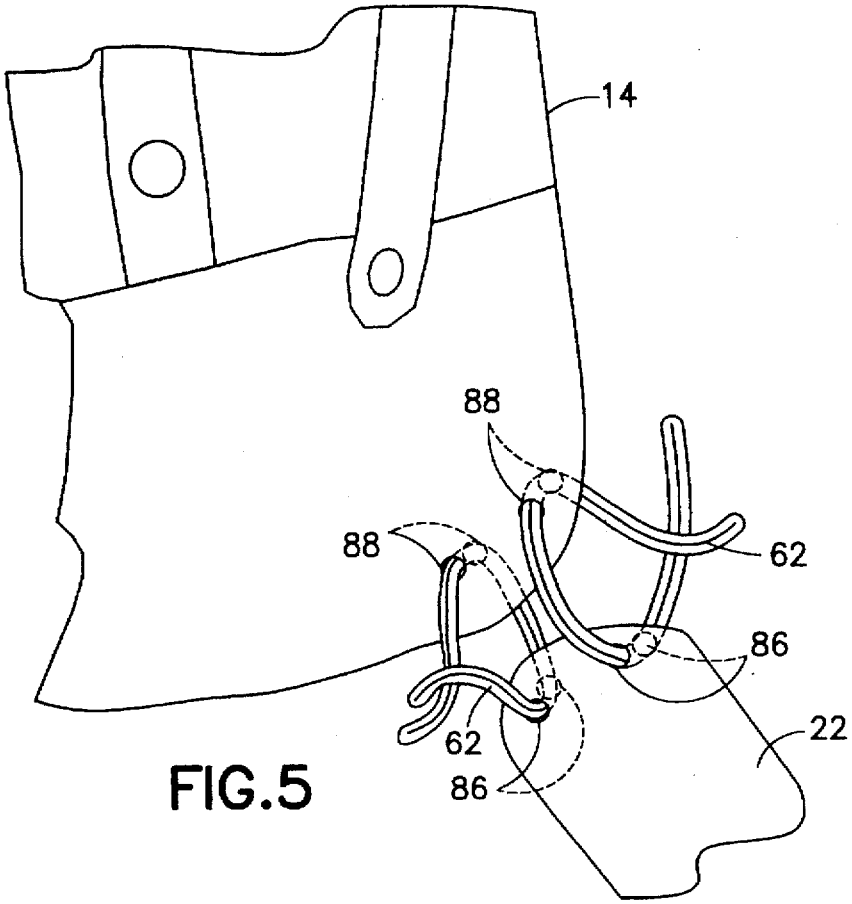
FIG.5

DECORATIVE FIGURE ASSEMBLY FROM COMBINATION OF COMPONENT BAGS

This application is related to co-owned Ser. No. 08/427,732 filed Apr. 24, 1995, which is a continuation of Ser. No. 08/276,773 filed Jul. 18, 1994 and now abandoned, which was a continuation of Ser. No. 07/554,967 filed Jul. 18, 1990 and now abandoned, which was a continuation of Ser. No. 07/384,728 filed Jul. 25, 1989 and now abandoned. This application is also related to Ser. No. 08/635,059 filed Apr. 19, 1996, which is a continuation of Ser. No. 08/261,848 filed Jun. 17, 1994 and now abandoned, which was a continuation-in-part of Ser. No. 07/891,398 filed May 29, 1992, now issued as U.S. Pat. No. 5,458,932, which was a continuation-in-part of Ser. No. 07/749,165 filed Aug. 23, 1991, now issued as U.S. Pat. No. 5,195,638, which was a continuation-in-part of Ser. No. 07/644,023 filed Mar. 4, 1991, now issued as U.S. Pat. No. 5,211,996, which was a continuation of Ser. No. 07/554,967 filed Jul. 18, 1990 and now abandoned; all of which are hereby incorporated by reference herein in their entireties.

BACKGROUND OF THE INVENTION

1. Field of the Invention

This invention relates broadly to decorative objects. More particularly, this invention relates to decorative objects having seasonal, holiday or festive indicia which are formed from a combination of component plastic bags which receive filler material.

2. State of the Art

During certain times of the year, holiday, seasonal, and festive decorative objects are very popular. In the fall, around the time of the Halloween celebration, common decorative objects have the image of a jack o'lantern or scarecrow. Following the Halloween celebration, and in the winter months, the image of Santa Claus is everpresent in holiday displays. During the spring, with the approach of the Easter holiday, images of Easter bunnies are often included in decorative displays.

In certain geographic locations during the fall season, leaves are on the ground, and homeowners often rake their leaves and dispose of them in relatively large leaf bags. Except for a new type of leaf bag (the details of which are disclosed in the related application hereto, Ser. No. 07/554,967) which has recently been sold during the Halloween season to represent or simulate a pumpkin, the known leaf bags are ordinary leaf bags with no particular significance and with no particular decorative value. Indeed, the leaf bags are considered an eye-sore. In addition, except for the bags disclosed in the related applications hereto, garbage or refuse bags are typically not decorative or theme-related, and the stuffing of such bags with leaves, paper or the like for decorative purposes during the holiday seasons has been unknown.

SUMMARY OF THE INVENTION

It is therefore an object of the invention to provide a combination of component plastic bags, which when filled with filler material such as leaves, crumpled newspaper, or the like, and provided with appropriate indicia, simulates a seasonal, festive, holiday, or non-holiday costumed figure.

It is further object of the invention to provide a simple, easy-to-manufacture, easy-to-assembly combination of objects for decorative use, either indoors or outdoors, which simulates a human-sized or human-proportioned costumed figure.

It is also an object of the invention to provide a simple, easy-to-manufacture, easy-to-assembly combination of objects for decorative use, either indoors or outdoors, which may be outfit with clothing and accessories.

In accord with these objects which will be discussed in detail below, the invention broadly comprises a combination of decorative bags representing the torso, head, two arms and two legs of a human which form a seasonal, festive, holiday or non-holiday figure. According to the preferred embodiment, the figure is proportioned and arranged so that it appears to be a costumed human. For example, a scarecrow, a scarecrow having a jack o'lantern head (hereinafter referred to as a "PUMPKIN-MAN", a trademark of the assignee hereof), a Pilgrim, a Santa Claus, an Easter Bunny, and a mannequin are all provided.

According to a preferred aspect of the invention, each of the component decorative bags is formed of a flexible waterproof material, preferably having a presealed end and an initially open end opposite the presealed end. The initially open end is for receiving filler material such as crumpled sheets of paper, leaves, empty beverage containers, or other refuse. The shape and size of the head bag are preferably chosen and the presealed end of the head bag is arranged such that the head bag assumes a generally spherical shape of appropriate size when filled with filler material. The shape and size of the torso bag are chosen, and the presealed end of the torso bag is arranged such that the torso bag assumes a generally cylindrical shape of appropriate size when filled with filler material. The size and shape of the two arm bags and two leg bags are chosen, and the presealed end of the bags are arranged such that the arm and leg bags assume a generally elongate cylindrical shape of appropriate size when filled with filler material. A closing means is provided for closing the initially open ends of the component bags.

The respective bags are preferably made of thin flexible plastic material, such as the material from which plastic leaf or garbage bags are made. At least the major portion of the outside surface of each bag in the assembly is preferably provided with coloration relevant to the figure represented, the holiday or festival being celebrated, and/or the purpose or occasion served by the decoration. For example, the major portion of the PUMPKIN-MAN is colored orange and black; the major portion of the Pilgrim is colored black and white; the major portion of the Santa Claus is colored red and white; the major portion of the Easter Bunny is pink and white; and the entirety of the mannequin is white. With the exception of the mannequin, indicia are also provided on the outside surface of each bag in the assembly to further decorate and supply basic and fanciful detail to the figures. For example, the PUMPKIN-MAN includes indicia representative of a jack o'lantern on the head bag, a plaid shirt and suspenders on the torso bag, and pant legs on the leg portions. The Pilgrim includes a head bag having facial and hat indicia, a torso bag having outer garment indicia, arm bags having sleeve and hand indicia, and leg bags having outer garment, pant leg, and boot indicia. The Santa Claus includes a torso bag having belt, belt buckle and fur trim indicia, arm bags having glove and fur trim indicia, and leg bags having boot and fur trim indicia. The Santa Claus further includes a cap bag which has indicia of a snowy white beard, a mouth, two eyes and, at the sealed end, a red cap and tassel. The cap bag is cut or formed so that when the Santa Claus figure is fully assembled, the beard indicia on the cap bag covers a portion of the torso bag. In addition, the cap bag may be filled at the sealed end with filler material and closed to create a substantially spherical tassel. The Easter Bunny has indicia including a fanciful bunny face with two eyes, a nose, a mouth and whiskers on the head bag, indicia of a button down shirt and suspenders on the torso bag, indicia of pant legs and paws on the leg bags, and indicia of shirt sleeves and bunny paws on the arm bags. The Easter Bunny figure further includes ear flap bags having bunny ear indicia, attachable to the head bag.

Each figure may be assembled by filling the head, torso, arm, and leg bags with filler material, i.e. leaves, paper, or empty beverage containers. The bags are then closed and clipped, tied or otherwise fastened together with the head bag on top, the torso bag beneath the head bag, the arm bags fastened to the upper position of the torso, and the legs bags attached to the lower portion of the torso bag to provide a decorative simulation of a scarecrow, a PUMPKIN-MAN, a Pilgrim, a Santa Claus or an Easter Bunny, or a mannequin. With respect to the Santa Claus, an additional elongate cap bag is draped over the filled head bag. The sealed end of the elongate cap bag is twisted and tied to simulate a tassel. With respect to the Easter Bunny, additional ear bags are either left empty or loosely filled with filler material and then attached to the head bag. The figures can be erected indoors or outdoors. The figures can also be posed in various positions as a result of articulable appendages. Furthermore, each of the figures can be given a more recognizable female form by the use of an extended torso bag which can be made to resemble a dress. Moreover, the figures can also be outfit with clothing, hats and other accessories.

Additional objects and advantages of the invention will become apparent to those skilled in the art upon reference to the detailed description taken in conjunction with the provided figures.

BRIEF DESCRIPTION OF THE DRAWINGS

FIG. 1 is a perspective view of an embodiment of the decorative combination Of the present invention simulating a PUMPKIN-MAN;

FIG. 2 provides an exploded view showing the components of the combination of FIG. 1 in separated form;

FIG. 2(A) is alternate embodiment of one of the components of FIG. 2;

FIGS. 4(A)–(B) show closure means for use in the present invention;

FIGS. 5 shows details of the means of assembly of the combination of the present invention shown in FIG. 1;

DETAILED DESCRIPTION OF THE PREFERRED EMBODIMENTS

Figure 10:
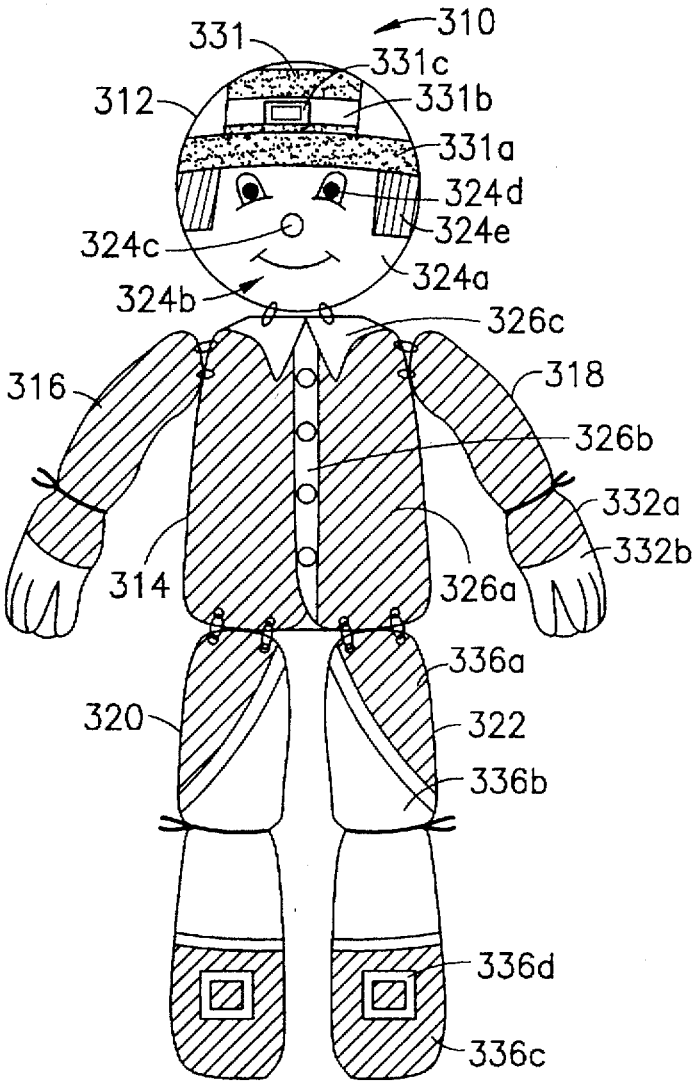
FIG. 10 is a side elevational view of a fourth embodiment of the decorative combination of the present invention simulating a Pilgrim.

Turning now to FIGS. 1 and 2, a decorative combination of a posable, human-sized and human proportioned scarecrow with pumpkin head ("PUMPKIN-MAN") decorative FIG. 10 comprises six bags: a head bag 12, a torso bag 14, two arm bags 16, 18, and two leg bags 20, 22. The bags have appropriate holiday coloring, having an orange base color and including black and yellow fanciful indicia. The head bag 12 includes jack o'lantern facial indicia 24, while the torso, arm and leg bags have garment indicia, described in detail below.

Figure 3A:
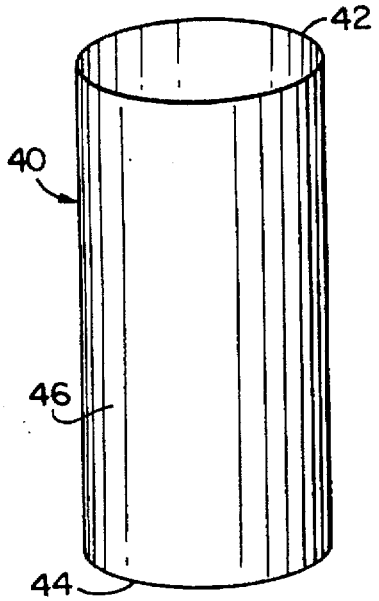
FIGS. 3(A)–3(E) are perspective views of flexible bags that can be used in forming a decorative combination of the present invention.
Figure 3B:
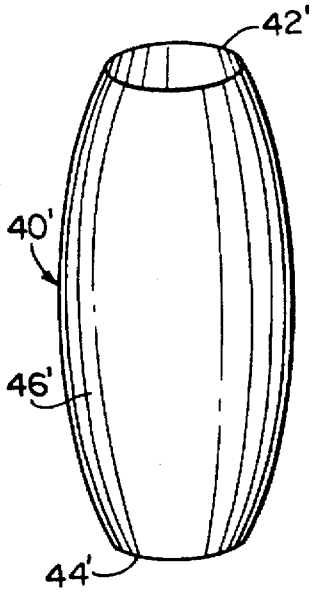
Figure 3C:
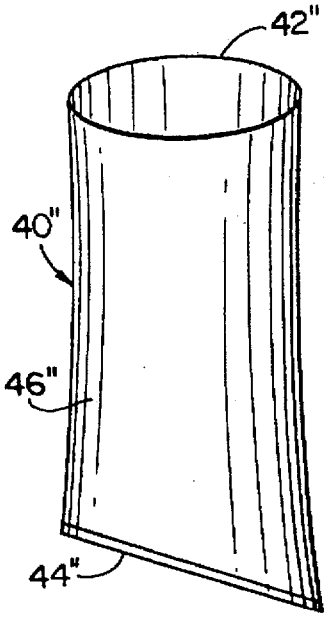
Figure 3D:
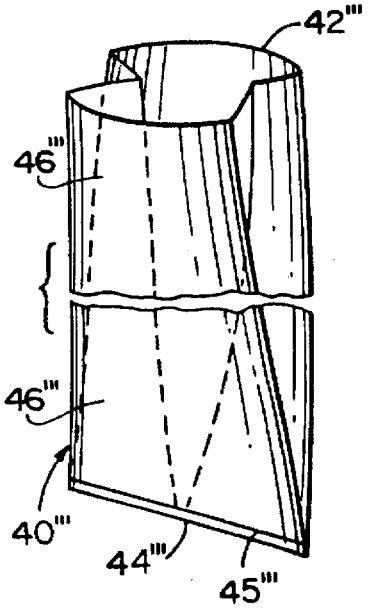
Figure 3E:
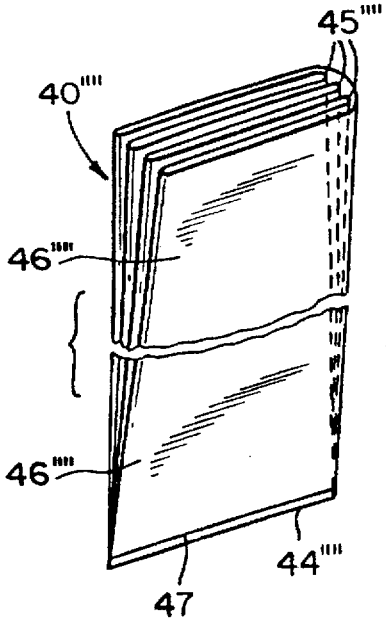

Each bag can be made from any of a numerous flexible bag types, examples of which are shown in FIGS. 3(A)–(E) and described fully in co-owned U.S. Pat. No. 5,458,932 previously incorporated herein. In brief, FIG. 3(A) shows a tubular bag 40 formed in a substantially cylindrical shape from flexible, waterproof plastic material; e.g., the type generally used for trash or leaf bags and suitable for indoor or outdoor use. Although bag 40 is shown having a cylindrical tubular configuration with first and second open ends 42 and 44 and a cylindrical wall 46, the bag may have any other suitable configuration within the scope of the present invention. For example, a convex cylindrical configuration bag 40' as shown in FIG. 3(B) or a conventionally shaped leaf or trash bag 40" as shown in FIG. 3(C) can also be used. As shown in FIG. 3(C), the closed bottom end 44" is closed by heat sealing. As a further alternative, a conventional gussetted bag 40'", as shown in FIG. 3(D) can be used. As a still further alternative, a bag 40"" (FIG. 3(E)) having a closed bottom end 44"" with a so-called Z-lock, provides a limited bunching effect of the bottom end of the bag when the bag is filled. In any case, the bag 40 has an upper open end 42 and a lower end 44 which may be open as shown in FIGS. 3(A) and 3(B) or which may be closed as shown in FIGS. 3(C), 3(D) and 3(E).

In accordance with one aspect of the present invention, bags 40–40"", when assembled and filled, according to the present invention, assume a substantially rounded form, as shown at 12 in FIG. 2 or substantially cylindrical form, as shown, at 14, 16, 18, 20 and 22 in FIG. 2, depending on the length of the cylindrical wall 46–46"". The bags assume their respective shapes as follows. First, one end of each of the six bags 14, 16, 18, 20, 22, unless presealed, is sealed by any suitable means, e.g. heat sealing, or twist tie means, etc., so as to form first closed ends 50, 52, 54, 56, 58, 60. Thereafter, the head 12 and torso 14 bags are filled with material, such as leaves, crumpled newspapers, paper scraps, empty beverage containers, or other light-weight materials, such that the head bag 12 assumes an almost rounded, generally spherical shape as shown at 12, and that the torso bag 14 assumes a generally ovoid shape as shown at 14. The arm bags 16, 18 and leg bags 20, 22 are each half filled and then closed off with a closure means 62 to form an articulable elbow or knee joint. The arm and leg bags are then filled the remainder of the way, so that they assume the shape of two elongate cylindrical portions with rounded ends. The open ends 65, 67, 69, 71, 73, 75 of the bags are then closed in a "bunched" manner by use of closure means such as ties 62 of FIG. 4(A) or flexible barbed straps 64 of FIG. 4(B), or a clamp or rubber band, or the like, so as to form tied together or bunched, generally rounded closed ends 66, 68, 70, 72, 74, 76 as shown in FIG. 2. Alternatively, the arm bags 16, 18 and leg bags 20, 22 may be filled completely and closed with closure means. At the midpoint of the length of the bags, the bags are crimped with tying means, such as pieces of string or cord, and the tying means are tied. As a result of the tying and crimping, elbow and knee joint regions are located on the arm bags and knee bags, respectively. The joint locations enable the arm and leg bags to be articulated into a desired position.

As mentioned above, each of the bags shown in FIGS. 1 and 2 preferably has indicia on its front and back outer surface to simulate the appearance of a PUMPKIN-MAN. Thus, facial indicia 24 can be provided separately or printed on the orange head bag 12. For example, as shown in FIG. 1, the facial indicia may include a yellow mouth 24*a*, a yellow nose 24*b*, and black and yellow eyes 24*c*, wherein the yellow represents the glow from a candle burning inside a carved pumpkin. The head bag may also include arced longitudinal black lines 25 from the first closed end 50 to the second open end 65 which represent the natural contours of a pumpkin. The torso bag includes black indicia of a plaid shirt 26, buttons 27, a pant portion 28, and suspenders 30. The arm bags 16, 18 include black indicia of plaid shirt arms 32. The leg bags 20, 22 include black indicia of pant legs 36. Preferably, such facial indicia 24 are preprinted on the outer surface of the head bag. Alternatively, the facial indicia are "self-stick" adhesive backed members for easy application. Likewise, the other indicia for the other bags may also be provided in a preprinted manner or applied as self-stick adhesive backed members.

In the decorative combination of the PUMPKIN-MAN of the present invention, outdoor-type bags are preferred as part of the bag assembly. By way of example, and not by way of limitation, the head bag may be about thirty inches tall by twenty-four inches wide (forming an approximately fifteen inch sphere when filled); the torso bag (unfilled) may be about thirty-five inches tall by seventeen inches wide with the pant portion indicia extending approximately thirteen inches up from the bottom of the bag and with the shirt indicia extending upward from the pant indicia to the top of the bag; and the arm and leg bags (unfilled) may be about thirty-five inches in length by eight and a half inches in width with the shirt and pant indicia extending from the closed end to approximately six inches from the open end. After the arm and leg-bags are assembled, the portions of the arm and leg bags which have no indicia can be shred to simulate straw 94, 95, 96, 97 extending from the arms and legs of the figure (see FIG. 1). Alternatively, the same portions can be printed with indicia to resemble straw, and then cut or left uncut. It will be appreciated that each of the provided bags preferably have corresponding indicia on back sides, not visible in FIGS. 1 and 2.

As discussed above, closure means are desirable for closing the stuffed bags 12, 14, 16, 18, 20, 22. Closure means may include a conventional twist tie 62, shown at FIG. 4(A), which comprises a flexible wire 78 embedded in flexible plastic 79 or paper. An alternative closure means is shown at 64 in FIG. 4(B) formed of a flexible plastic strap 80 with barbs 81 which engage the strap when the tapered end 82 of thereof is threaded through opening 83. These types of closure means are commercially available and are shown only by way of example, as other ties or closure means can be used.

It will be appreciated that any suitable dimensions and material can be used with bags 40–40"". However, in a typical embodiment, it is preferred that all of the bags be made of polyethylene or a similar waterproof material having a thickness in the range of about 0.5–5 mils, with a preferred thickness of about 1.3 mils.

The bags are assembled to one another by coupling means. The coupling means may be the same as the closure means, i.e., conventional twist tie closures, or the bags may be coupled by the use of staples. Using twist ties, the structure of the present invention is assembled as shown in FIG. 5. In particular, holes 86 are punched into the top of the leg bags. Holes 88 are also punched into opposing side walls of the lower portion of the torso bag. Each leg is coupled to one side of the lower portion of the torso by weaving a relatively long conventional tie 62 through the holes in the leg bags and the holes in the lower portion of the torso bag. Once the ties have been weaved through the holes 86, 88, the ties are twisted such that they secure the leg bags 20, 22 to the torso bag 14. Likewise, holes 90 are punched into the top of the arm bags 16, 18 and holes 92 are also punched into opposing side walls of the upper portion (analogous to shoulder areas) of the torso bag 14. In the same manner as the leg bags are coupled to the torso bag, each arm bag is coupled to one of the shoulder areas by weaving conventional ties through the holes 90 in the arm bags and the holes 92 in the shoulder areas of the torso bag 14. The head bag 12 is positioned on top of the torso bag 14 in vertical alignment therewith such that the conventional tie member 62 of the head bag 12 is closely adjacent to the conventional tie member of the torso bag 14. The head bag 12 is secured to the top of the torso bag 14 preferably using a conventional tie to couple the rounded closed end 66 of the head bag 12 to the rounded closed end 68 of the torso bag 14. It will be appreciated that holes can be already provided in the bags, eliminating the need for punching the holes during assembly.

Figure 6A:
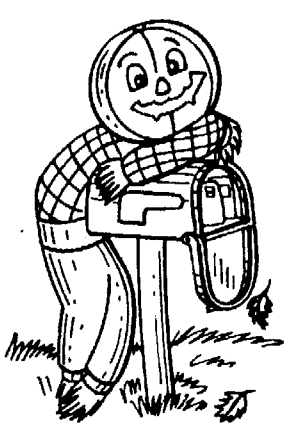
FIGS. 6(A)–(G) illustrate the articulacy of the appendages of the embodiment of the invention shown in FIG. 1 and several positions in which the same embodiment can be posed.
Figure 6B:
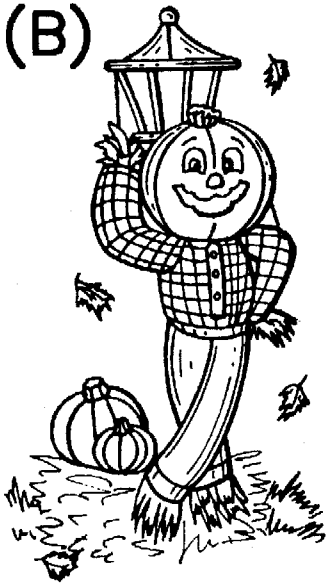
Figure 6C:
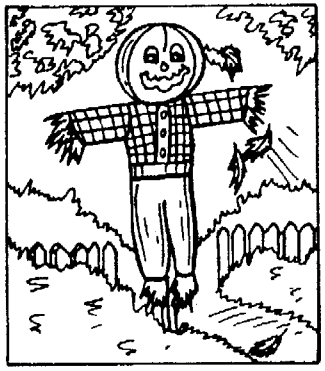
Figure 6D:
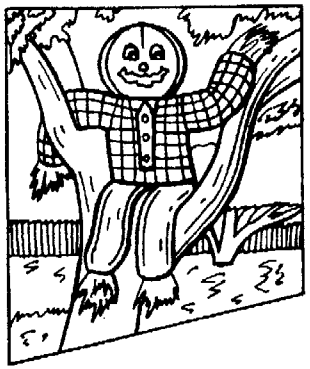
Figure 6E:
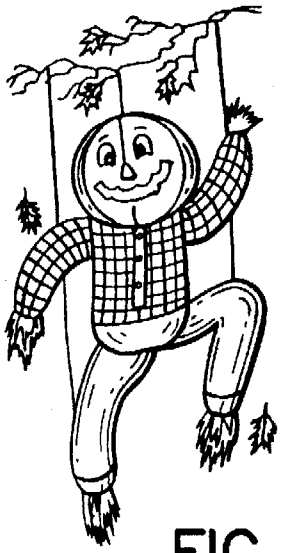
Figure 6F:
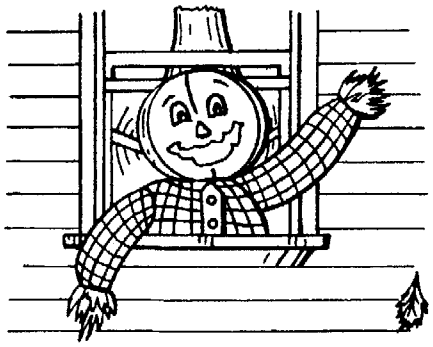
Figure 6G:
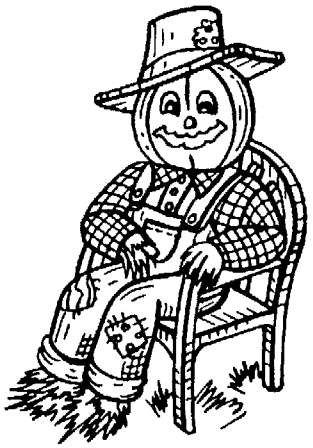

Referring to FIGS. 6(A)–(F), once assembled, the PUMPKIN-MAN figure can be posed in a variety of positions and/or dressed in clothing. For example, and not byway of limitation, the figure may be propped and secured against a support in a leaning position (FIG. 6(A)) or in a standing position (FIG. 6(B)). The figure may also be configured as a scarecrow on a pole (FIG. 6(C)). Additionally, due to the articulacy of the elbow and knee joints, the figure may be seated (FIGS. 6(D) and 6(G)), suspended from a tree (FIG. 6(E)) or placed into many other positions permissible by articulating joints. Furthermore, the figure may be propped at a window, partially extending outdoors (FIG. 6(F)), or situated entirely indoors as an indoor decorative display (not shown). Common cord may be use to secure the figure to a support or to suspend the figure from a tree. In addition, since the figure is preferably of human size and proportion, the figure may be dressed in human clothing (FIG. 6(G)), fit with hats (also FIG. 6(G)), and/or outfit with accessories (not shown).

Figure 7:
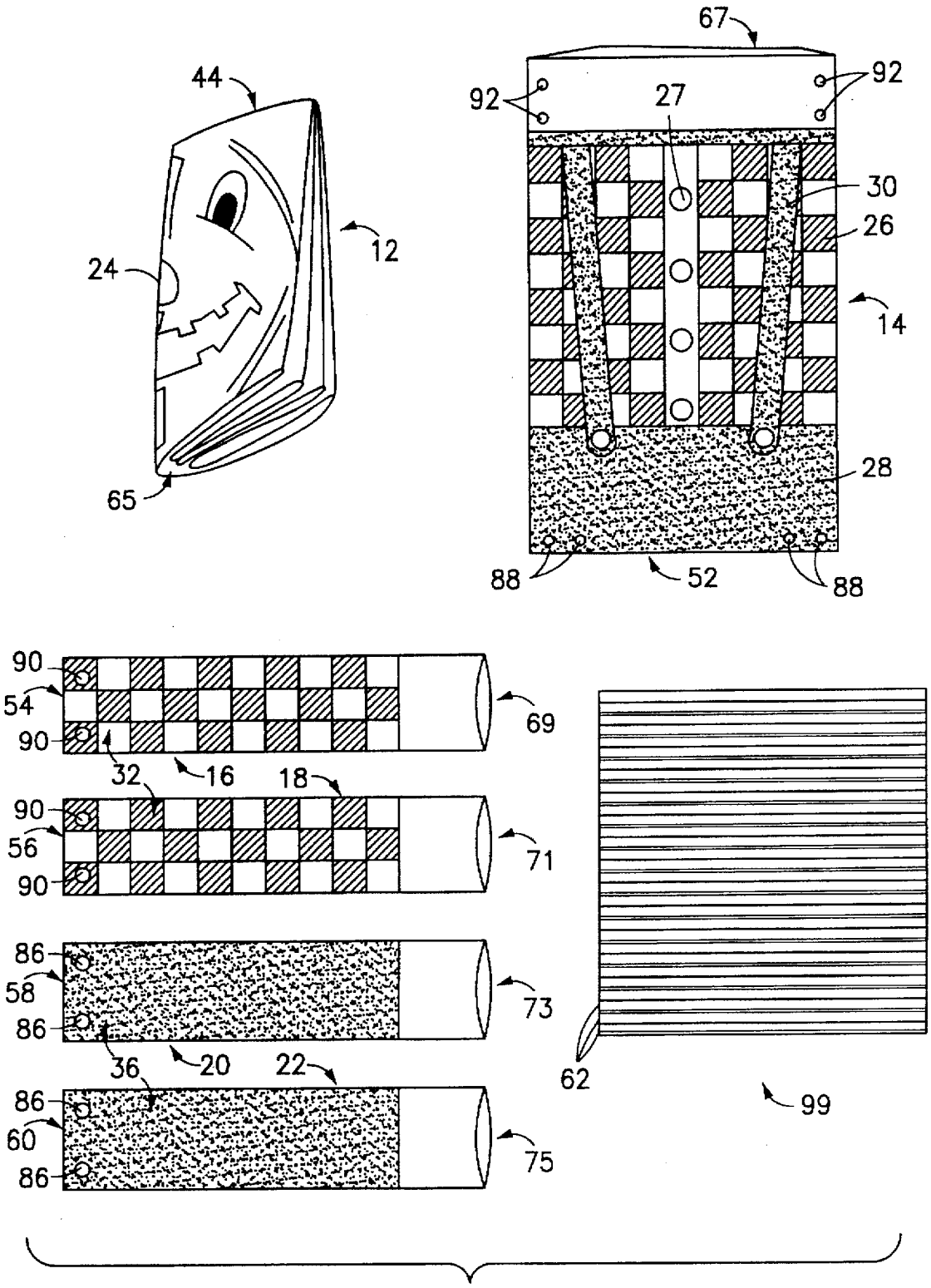
FIG. 7 illustrates a kit for a decorative combination of the present invention as shown in FIG. 1.

In a preferred aspect of the invention, a kit 99 for the combination of a PUMPKIN-MAN is shown in FIG. 7 and comprises at least six flexible bag members 12, 14, 16, 18, 20 and 22 which are preferably of sizes relational to the different sizes hereinabove described, and a plurality of closure means and coupling means such as ties 62. The head bag 12 is preferably a Z-lock type gussetted bag, having a heat sealed closed end, an open end 65, and jack o'lantern indicia 24. The torso bag 14 includes a heat sealed closed end 52, an open end 67, and garment indicia. The arm bags 16, 18 include a closed heat sealed end 54, 56, an open end 69, 71, and garment indicia 32. The leg bags 20, 22 include a closed heat sealed end 58, 60 and an open end 73, 75 and are black over a majority of the bag to represent a pant leg 36. A plurality of closure means are provided for closing the open ends of the bags and for forming joints. A plurality of coupling means are also provided for attaching the head, arm and leg bags to the torso bag. Preferably, directions are supplied with the kit which indicate where to punch holes for which to thread through the coupling means. Alternatively, holes 86, 88, 90, 92 are provided in the various bags indicating where coupling means should be weaved through the various bags to assist in assembly. As a further alternative, indicia are printed on the various bags indicating where holes may be poked through the bag so that the coupling means may be weaved through the bags in the assembly. It should be recognized that the holes can be located or indicia for holes may be indicated at positions other than as shown in FIG. 7. For example, holes on the torso bag for alignment with holes on the leg bag may be indicated along the lower sides of the torso bag, rather than along the closed end of the torso bag.

Referring back to FIG. 2 and with reference to FIG. 2(A), it will be appreciated that an alternate embodiment of the PUMPKIN-MAN can be assembled having like parts of like design with two distinctions. First, rather than use a jack o'lantern head 12, the figure is assembled with a scarecrow head 12*a* (with like parts having similar numbers appended by an "a"). The scarecrow head includes fanciful scarecrow facial indicia. For example, the scarecrow head 12*a* may include a stitched mouth 24*aa*, a button nose 24*ba*, eyes 24*ca*, and patchwork cheeks 24*da*. Other feature, stitching, patchwork or straw-like indicia may likewise be included on the head bag 12*a*. The indicia may also be included in a variety of colors. Second, it is preferable that the scarecrow head 12*a* and the component bags to which it is assembled predominantly have yellow and black coloration, rather than the predominant orange and black coloration used on the PUMPKIN-MAN. The head bag 12*a* may also be supplied in a kit along with the torso bag 14, the arm bags 16, 18 and the leg bags 20, 22.

Figure 8:
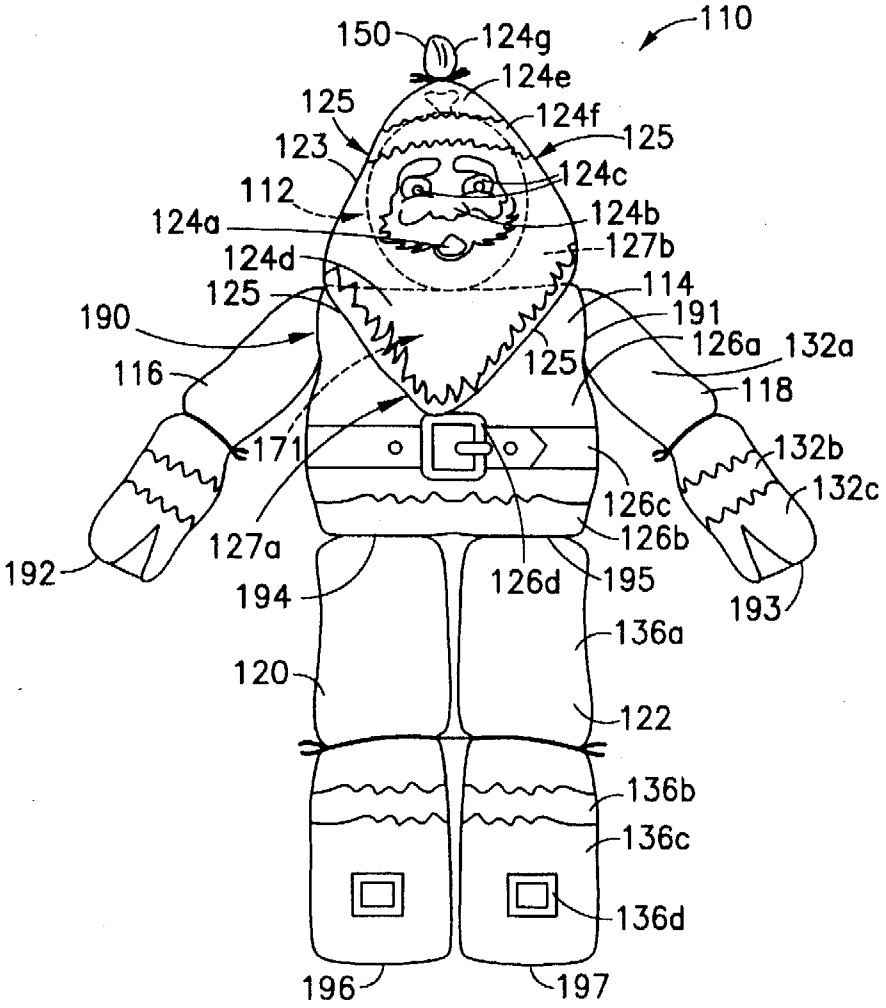
FIG. 8 is a side elevational view of a second embodiment of the, decorative combination of the present invention simulating a Santa Claus.

Turning now to FIG. 8, a second embodiment of a human-sized bag assembly figure, substantially similar to the first embodiment is shown (with numbers incremented by 100 referring to like parts of the first embodiment). A decorative human-sized and human-proportioned Santa Claus FIG. 110 includes a combination of seven bags: a head support bag 112, a torso bag 114, two arm bags 116, 118, two leg bags 120, 122, and a cap bag 123. The arm bags 116, 118 and leg bags 120, 122 are coupled to the torso bag 114 in a configuration similar to that of the first embodiment, with the exception that preferably the open ends 190, 191 of the arm bags 116, 118 and the open ends 194, 195 of the leg bags 120, 122 are located adjacent the torso bag 114, with the sealed ends 192, 193 of the arm bags and the sealed ends 196, 197 of the leg bags located opposite the torso bag.

The head support bag 112, torso bag 114, arm bags 116, 118, and leg bags 120, 122 are of a similar construction as the bags of the first embodiment and are likewise filled, closed, and assembled in a manner similar to the first embodiment. One exception to the likewise manner of assembly is that the arm bags 116, 118 and leg bags 120, 122 are coupled to the torso bag 114 in a configuration similar to that of the first embodiment, with the exception that preferably the open ends 190, 191 of the arm bags 116, 118 and the open ends 194, 195 of the leg bags 120, 122 are located adjacent the torso bag 114, with the sealed ends 192, 193 of the arm bags and the sealed ends 196, 197 of the leg bags located opposite the torso bag. The head support bag sits on and is coupled to a relatively rotund torso bag and stocky arm bags and leg bags are also assembled to the torso bag. By way of example, and not by way of limitation, the head support bag (unfilled) may be about thirty-six inches tall by thirty-six inches wide; the torso bag (unfilled) may be about thirty-eight inches tall by twenty-eight inches wide; the arm bags (unfilled) may be about thirty-eight inches in length by eleven inches in width, and the legs bags (unfilled) may be about thirty-eight inches in length by twelve and a half inches in width. In addition, the cap bag 123, of a similar construction as the other bags, is preferably sized at about twenty-seven inches in length by twenty-seven inches in width, with two adjacent sealed sides 124 and two adjacent open sides 125. As a result of the two adjacent open sides, two triangular flaps 127*a*, 127*b* of the bag material are formed.

The cap bag 123 may be filled at a sealed end with a small amount of filler material and closed with a tie to create a substantially spherical tassel portion 150. The cap bag is then fit over the head bag with the first triangular flap 127*a*, including beard indicia, described below, extending partially over the front of the torso bag 114 and the second triangular flap 127*b*, extending partially over the back of the torso bag. The cap bag 123 is secured on the head bag by inserting a closure means, for example a conventional twist tie, through the back of the cap bag, into the head bag, and back out of the cap bag, where the tie is twisted into a closed configuration.

With the exception of the head support bag 112 (which is covered by the cap bag 123), each of the bags preferably has indicia on its outer surface to simulate the appearance of Santa Claus. Thus, facial indicia 124 can be provided separately or printed on the cap bag 123. For example, as shown in FIG. 8, the facial indicia may include a red mouth 124*a*, a pinkish nose and surrounding features 124*b*, black and white eyes 124*c*, and white beard 124*d*. In addition, the cap bag includes indicia of a red cap 124*e*, white fur trim 124*f* and a tassel 124*g*. The torso bag 114 includes indicia of a red coat 126*a*, white fur trim 126*b*, and a belt 126*c* and buckle 126*d*. The arm bags 116, 118 include indicia of red sleeves 132*a*, white fur trim 132*b* and gloves 132*c*. The leg bags 120, 122 include indicia of red pant legs 136*a*, white fur trim 136*b*, and black boots 136*c* with a yellow buckle 136*d*. The head support bag should preferably be of a neutral color, such as white, so that the color of the head support bag is not apparent through the cap bag, and further does not detract from the indicia on cap bag. The bags and indicia for the Santa Claus figure may also be supplied in a kit.

Figure 9:
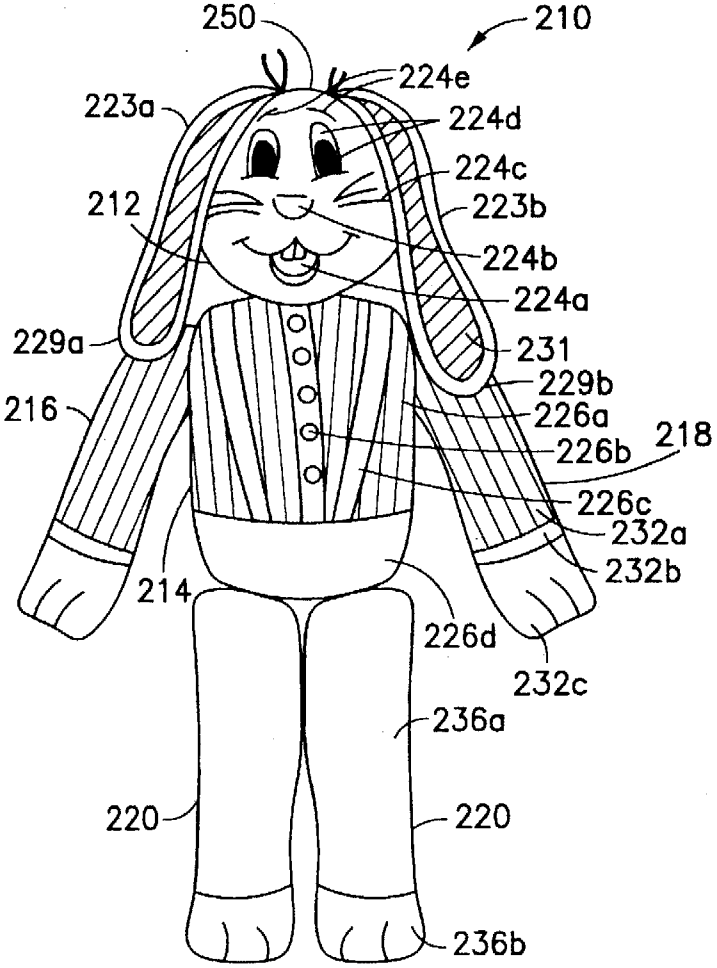
FIG. 9 is a side elevational view of a third embodiment of the decorative combination of the present invention simulating a costumed human Easter Bunny.

Referring to FIG. 9, a third embodiment of a human-sized bag assembly figure, substantially similar to the first embodiment is shown (with numbers incremented by 200 referring to like parts of the first embodiment). A decorative "humanized" Easter Bunny figure 210 includes a combination of eight generally white and/or pink bags: a head bag 212, a torso bag 214, two arm bags 216, 218, two ear bags 223*a*, 223*b*, and two leg bags 220, 222.

The head 212, torso 214, arm 216, 218, and leg 220, 222 bags are of a similar construction as the bags of the first embodiment. The head and torso bags are likewise filled, closed, and assembled in a manner similar to the first embodiment. The arm and leg bags are completely filled and then crimped with tying means to create elbow and knee joints. In addition, two elongate bags 223*a*, 223*b* having a width which increases toward a rounded sealed end 229*a*, 229*b* are preferred for the ears.

The head bag 212 sits on and is coupled to the torso bag 214 and the arm bags 216, 218 and leg bags 220, 222 are further assembled to the torso bag 214. The ear bags 223*a*, 223*b* are coupled to the sealed end 250 of the head bag 212 by conventional ties. By way of example, and not by way of limitation, the head bag (unfilled) may be about seventeen and a half inches by twenty-five inches; the torso bag (unfilled) may be about thirty-five inches tall by seventeen inches wide; the arms and legs bags (unfilled) may be about thirty-five inches in length by eight and a half inches in width; and the ear flap bags (unfilled) may be about twenty-five inches in length and nine inches in width at their widest.

Each of the bags preferably has indicia on its outer surface to fancifully render a human in an Easter Bunny costume. Easter Bunny facial indicia 224 can be provided separately or printed on the head bag 212. For example, as shown in FIG. 9, the facial indicia may include a black mouth and pink tongue 224*a*, a pink nose 224*b*, whiskers 224*c*, black and white eyes 224*d*, and eyebrows 224*e*. The ear bags include pink ear markings 231. The torso bag 214 includes indicia of a pink striped shirt 226*a*, buttons 226*b*, pink suspenders 226*c* and a pink top pant portion 226*d*. The arm bags 216, 218 include indicia of pink striped sleeves 232*a*, pink cuffs 232*b* and front paws 232*c*. The leg bags 220, 222 include indicia of pink pant legs 236*a* and rear paws 236*b*. The bags and indicia for the Easter Bunny posable figure may also be supplied in a kit.

A fourth embodiment, as shown in FIG. 10, illustrates a human-sized bag assembly, substantially similar to the first embodiment (with numbers incremented by 300 referring to like parts of the first embodiment) and representing a decorative Pilgrim. The Pilgrim FIG. 310 includes a combination of six bags: a head bag 312, a torso bag 314, two arm bags 316, 318, and two leg bags 320, 322. The head 312, torso 314, arm 316, 318, and leg 320, 322 bags are of similar size and construction as the bags of the first embodiment. The head, torso, arm and leg bags are likewise filled, closed, and assembled in a manner similar to the first embodiment.

The head bag 312 vertically sits on and is coupled to the torso bag 314 and the arm bags 316, 318 and leg bags 320, 322 are further assembled to the torso bag 314. By way of example, and not by way of limitation, the head bag (unfilled) may be about seventeen and a half inches by twenty-five inches; the torso bag (unfilled) may be about thirty-five inches tall by seventeen inches wide; and the arm and leg bags (unfilled) may be about thirty-five inches in length by eight and a half inches in width.

Each of the bags preferably has indicia on its, outer surface to simulate the appearance of a Pilgrim. Pilgrim facial indicia can be provided separately or printed on the head bag 312. For example, as shown in FIG. 10, the facial indicia may include a pinkish facial area 324*a* having a black mouth 324*b*, a nose 324*c*, black and white eyes 324*d*, and brown hair 324*e*. A pilgrim-style hat 331 is also indicated with a brim 331*a*, and hat band 331*b* and a hat buckle 331*c*. The torso bag 314 includes indicia of an overcoat 326*a*, buttons 326*b*, and a collar 326*c*. The arm bags 216, 218 include indicia of sleeves 232*a* and hands 232*b*. The leg bags 220, 222 include indicia of the lower portion of an overcoat 236*a*, pant legs 236*b*, and boots 236*c* having a buckle 236*d*. The bags and indicia for the Pilgrim posable figure may also be supplied in a kit.

Figure 11:
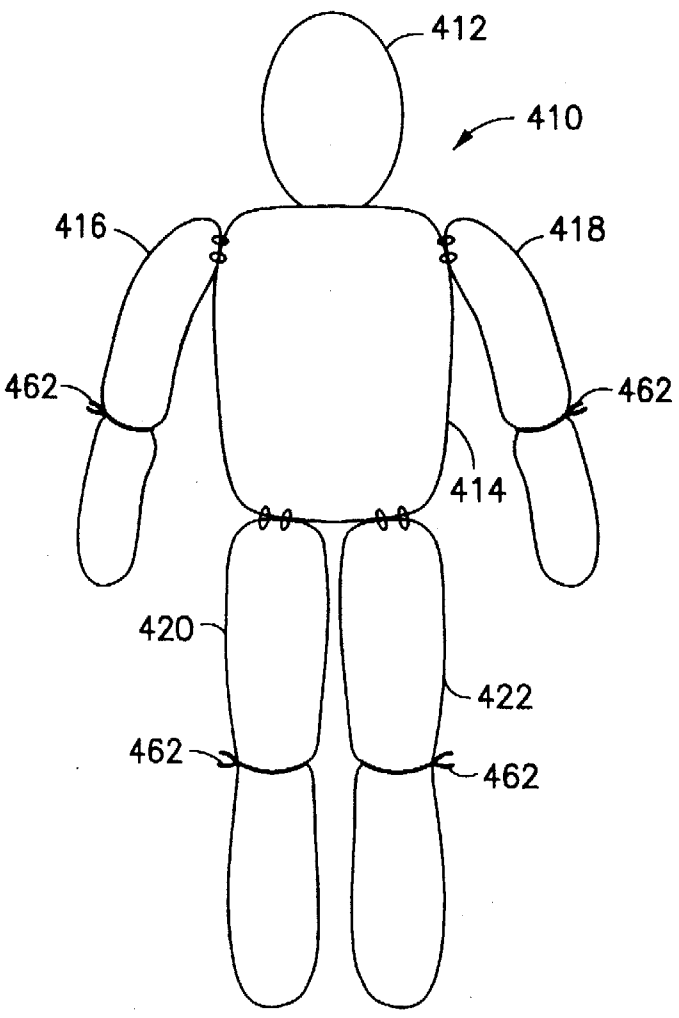
FIG. 11 is a side elevational view of a fifth embodiment of the combination of the present invention.

A fifth embodiment, as shown in FIG. 11, illustrates a human-sized and human-proportioned bag assembly, substantially similar to the first embodiment (with numbers incremented by 400 referring to like parts of the first embodiment) which acts like a mannequin. The mannequin 410 includes a combination of six bags: a head bag 412, a torso bag 414, two arm bags 416, 418, and two leg bags 420, 422. The torso 414, arm 416, 418, and leg 420, 422 bags are of similar size and construction as the bags of the first embodiment, with the exception that the head bag 412, when filled, is substantially the size of a human head. The head, torso, arm and leg bags are filled, closed, and assembled in a manner similar to the first embodiment. Each of the bags is neutral in color, preferably white. A preferred aspect of this embodiment is that the bags include no indicia. Having no indicia on the bags of the mannequin enables a user to personalize the mannequin with the user's own choice of design or facial features or to alternatively decide to leave the mannequin without features. The mannequin may be clothed and outfit with hats and other accessories, and displayed indoors or outdoors, in a home, retail, promotional, recreational, or other setting. The bags for the mannequin figure may also be supplied in a kit.

Figure 12:
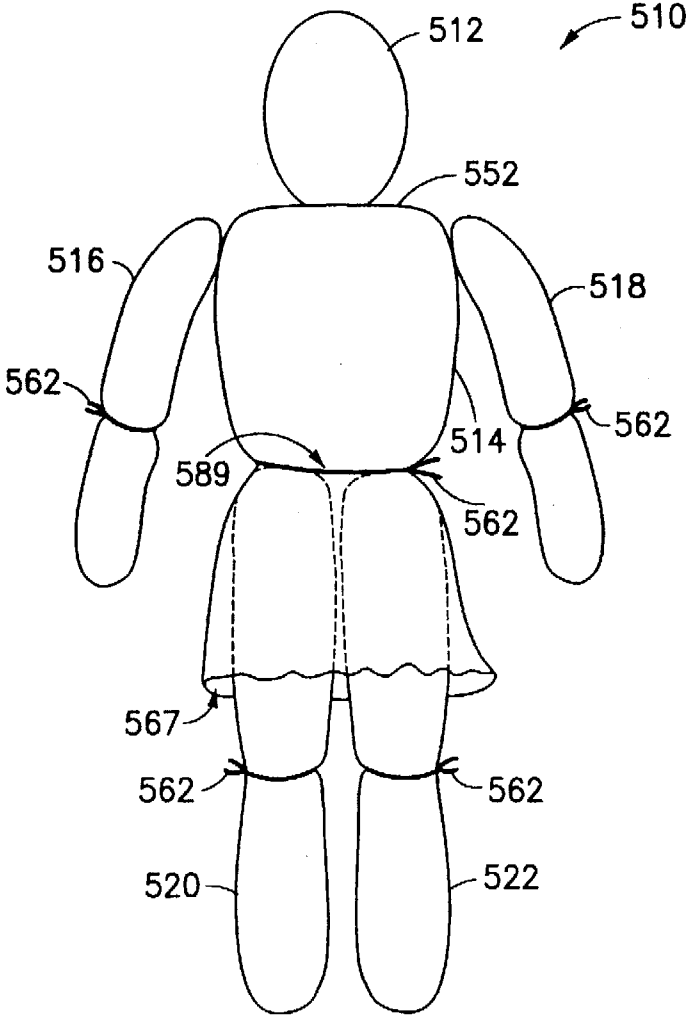
FIG. 12 is a side elevational view of a sixth embodiment of the combination of the present invention.

A sixth embodiment, as shown in FIG. 12, illustrates a man-human-proportioned bag assembly, substantially similar to the fifth embodiment (with numbers incremented by 100 referring to like parts of the fifth embodiment). The sixth embodiment includes a torso bag 514 which, prior to filling with filler material, is substantially longer than in the previous embodiments. During assembly, the torso bag 514 is partially filled (approximately half filled), and then closed 568 with closure means 562. Then, the unfilled portion of the torso bag 514 is pulled around the filled portion of the torso bag, and the leg bags 520, 522 are assembled using coupling means 562 to the torso bag adjacent the closed end 568. The unfilled portion for the torso bag 514 is then pulled down over the leg bags 520, 522, thereby creating the appearance that the open end 567 of the torso bag is a dress bottom. The head bag 512 is attached to the sealed end 552 of the torso bag 514.

It will be appreciated that with the substitution of the longer torso bag 514 into any of the other embodiments, any of the other embodiments can be configured to resemble a female figure. Of course, the indicia should also be appropriately altered to represent a female figure. The longer torso bag 514 may likewise be substituted for the previously described torso bags 14, 114, 214, 314, 414, 514 in any of the preceding kits.

There have been described and illustrated herein several embodiments of a seasonal, festive, holiday, or non-holiday figure assembled from several bag components. While particular embodiments of the invention have been described, it is not intended that the invention be limited thereto, as it is intended that the invention be as broad in scope as the art will allow and that the specification be read likewise. Thus, while particular figures have been disclosed to be human-sized and human-proportioned, it will be appreciated that the figure need not be both human-sized and human-proportioned. In particular, the figure may be human-sized and not human-proportioned (as in a human-sized PUMPKIN-MAN having an oversized head) or the figure may be human-proportioned and not human-sized (for example, a humanized Easter Bunny substantially larger than a human). In addition, while particular figures have been disclosed, it will be recognized that other seasonal, festive, holiday, and non-holiday figures can likewise be made from similar components having different indicia. For example, and not by way of limitation, an Uncle Sam, Mrs. Claus, Dracula, Frankenstein's monster, a witch, a skeleton, a mummy, a leprechaun, an elf, a farmer, a farmer's wife, historical figures (e.g. Abraham Lincoln, Mark Twain, etc.), cartoon characters, and famous celebrity likenesses can likewise be assembled or supplied in kit form. Furthermore, while particular coupling means for assembling the figure have been disclosed, it will be understood that other coupling means can be used, as discussed in previously incorporated co-owned U.S. Pat. No. 5,458,932. Moreover, while particular types and sizes of bags have been disclosed, other bag types and sizes can also be utilized. In addition, "bags" can be used which have two open ends, wherein one end is closed by coupling means prior to filling the "bag" and the other end is closed by coupling means after filling the "bag". It will also be understood that the bags, as shown in the drawings, may be reversed, whereby the location of the open end and the sealed end with respect to the indicia are reversed. For example, where any of the bags is shown to have a sealed end adjacent the torso bag, it will be appreciated that the bags can be printed with indicia such that the bags will be correctly configured when the sealed ends are opposite the torso bag, and vice versa (compare head bag on FIGS. 6(A) and 6(B)). Furthermore, the torso bag can be printed in reverse such that the sealed end of the torso bag is either adjacent to the head bag or opposite the head bag. It will therefore be appreciated by those skilled in the art that yet other modifications could be made to the provided invention without deviating from its spirit and scope as so claimed.

I claim:

1. A decorative figure assembly, comprising:

a) a non-fluid filling, material;

b) a plurality of individual closure means each for closing a bag;

c) a plastic torso bag containing a first portion of said filling material and having an open end being closed by a first of said plurality of closure means;

d) a plastic head bag containing a second portion of said filling material and having an open end being closed by a second of said plurality of closure means;

e) two plastic arm bags containing third and fourth portions, respectively, of said filling material and each having an open end being closed by a third and a fourth of said plurality of closure means, respectively;

f) two plastic leg bags containing fifth and sixth positions, respectively, of said filling material and each having an open end being closed by fifth and sixth of said plurality of closure means, respectively; and g) a plurality of coupling means for coupling said torso bag to said head bag, to said arm bags, and to said leg bags, wherein said head bag, said arm bags, and said leg bags are coupled by said plurality of coupling means to said torso bag and form a figure proportioned to a costumed human.

2. A decorative figure assembly according to claim 1, wherein:

said decorative figure is substantially adult human-sized.

3. A decorative figure assembly according to claim 1, wherein:

said torso bag, said head bag, said arm bags, and said leg bags are made of a flexible, waterproof material.

4. A decorative figure assembly according to claim 1, further comprising:

g) fanciful indicia on at least one of said torso bag, said head bag, said arm bags, and said leg bags.

5. A decorative figure assembly according to claim 4, wherein:

said head bag includes fanciful pumpkin indicia.

6. A decorative figure assembly according to claim 5, wherein:

said torso bag, said arm bags, and said leg bags include fanciful garment indicia.

7. A decorative figure assembly according to claim 4, wherein:

said torso bag, said arm bags, and said leg bags include fanciful Santa Claus indicia.

8. A decorative figure assembly according to claim 7, further comprising:

h) a cap bag extended over said head bag, wherein said cap bag includes facial, beard, cap, and tassel indicia.

9. A decorative figure assembly according to claim 4, wherein:

said torso bag, said head bag, said arm bags, and said leg bags have Easter Bunny indicia.

10. A decorative figure assembly according to claim 9, further comprising:

h) two ear bags;

i) second coupling means for coupling said ear bags to said head bag, wherein said ear bags are coupled to said head bag by said second coupling means.

11. A decorative figure assembly according to claim 4, wherein:

said torso bag, said head bag, said arm bags, and said leg bags include Pilgrim indicia.

12. decorative figure assembly according to claim 4, wherein:

said torso bag, said head bag, said arm bags, and said leg bags include fanciful scarecrow indicia.

13. A decorative figure assembly according to claim 1, wherein:

said torso bag is partially filled such that a substantial portion of said torso bag remains unfilled and thereby resembles a dress worn over a human torso.

14. A decorative figure assembly according to claim 1, wherein:

said two arm bags and said two leg bags having articulating joint portions.

15. A decorative figure assembly according to claim 1, wherein:

said arms bags are coupled to an upper portion of said torso bag.

16. A kit for making a decorative figure, said kit comprising:

a) a non-elastic plastic torso bag having an open end which when filled will assume substantially the form of a human torso;

b) a non-elastic plastic head bag having an open end which when filled will assume the form of a head;

c) two non-elastic plastic arm bags, each having an open end, and each which when filled will assume substantially the form of a human arm;

d) two non-elastic plastic leg bags, each having an open end, and each which when filled will assume substantially the form of a human leg; and e) a plurality of closure means for closing said open ends of said torso bag, said head bag, said arm bags, and said leg bags, wherein said open end of each of said torso bag, said head bag, said arm bags, and said leg bags is sufficiently wide to permit said bags to be filled with leaves or newspapers.

17. A kit according to claim 16, further comprising:

f) first coupling means for coupling said head bag, said arm bags, and said leg bags to said torso bag.

18. A kit according to claim 17, further comprising:

g) fanciful indicia on at least one of said torso bag, said head bag, said arm bags, and said leg bags.

19. A kit according to claim 18, wherein:

said head bag includes fanciful pumpkin indicia.

20. A kit according to claim 19, wherein:

said torso bag, said arm bags, and said leg bags include fanciful garment indicia.

21. A kit according to claim 18, further comprising:

h) a cap bag for extending over said head bag, wherein said torso bag, said arm bags, said leg bags, and said cap bag include fanciful Santa Claus indicia.

22. A kit according to claim 18, further comprising:

h) two ear bags; and i) second coupling means for coupling said ear bags to said head bag, wherein said torso bag, said head bag, said leg bags, and said arm bags include fanciful Easter Bunny indicia.

23. A kit according to claim 18, wherein:

said torso bag, said head bag, said leg bags, and said arm bags include fanciful Pilgrim indicia.

24. A kit according to claim 16, wherein:

at least one of said plurality of closure means also constitutes a coupling means for coupling one of said head bag, said arm bags, said leg bags, and said torso bag, to another of said head bag, said arm bags, said leg bags, and said torso bag.

25. A kit according to claim 16, wherein:

said torso bag, said head bag, said arm bags, and said leg bags are made of a flexible, waterproof material.

26. A kit according to claim 16, wherein:

said torso bag, and said leg bags are human-proportioned.

* * * * *